US011597228B2

(12) United States Patent
Ochi et al.

(10) Patent No.: US 11,597,228 B2
(45) Date of Patent: Mar. 7, 2023

(54) ADDITIONAL MEMBER ATTACHING APPARATUS AND BINDING SYSTEM INCLUDING THE SAME

(71) Applicant: Horizon Inc., Takashima (JP)

(72) Inventors: Masaru Ochi, Takashima (JP); Shigenobu Fukuda, Takashima (JP); Kanta Kambara, Takashima (JP); Akira Nonoshita, Takashima (JP)

(73) Assignee: Horizon Inc., Takashima (JP)

( * ) Notice: Subject to any disclaimer, the term of this patent is extended or adjusted under 35 U.S.C. 154(b) by 0 days.

(21) Appl. No.: 17/331,343

(22) Filed: May 26, 2021

(65) Prior Publication Data

US 2021/0379920 A1 Dec. 9, 2021

(30) Foreign Application Priority Data

Jun. 3, 2020 (JP) ..... JP2020-096845
Apr. 22, 2021 (JP) ..... JP2021-072668

(51) Int. Cl.
*B42C 19/08* (2006.01)
*B42C 9/02* (2006.01)
(Continued)

(52) U.S. Cl.
CPC ..... *B42C 19/08* (2013.01); *B42C 9/02* (2013.01); *B65H 35/0086* (2013.01);
(Continued)

(58) Field of Classification Search
CPC ..... B42C 9/02; B42C 19/08; B42C 11/02; B42C 11/04; B65H 35/02; B65H 35/08; B65H 35/0086
(Continued)

(56) References Cited

U.S. PATENT DOCUMENTS 2,646,104 A 7/1953 Hawkes
3,166,463 A 1/1965 Klostermann
(Continued)

FOREIGN PATENT DOCUMENTS

DE 44 23 093 A1 1/1996
DE 100 05 493 A1 9/2001
(Continued)

OTHER PUBLICATIONS

Extended European Search Report for European Application No. 21176221.6 dated Dec. 22, 2021.
(Continued)

*Primary Examiner* — Leslie A Nicholson, III
(74) *Attorney, Agent, or Firm* — Muncy, Geissler, Olds & Lowe, P.C.

(57) ABSTRACT

The first cutter that cuts, in the direction transverse to the unwinding direction, a continuous sheet of additional member unwound and drawn by a length in accordance with the thickness of the book block is arranged at the input port of the trimming station, the transport mechanism that transports the cut additional member from the first cutter out in the unwinding direction of the continuous sheet of additional member is arranged downstream of the first cutter, the second cutter that trims the cut additional member being transported on the transport path in the unwinding direction is arranged in the transport path of the transport mechanism, and the position of the blades of the second cutter may be adjusted in the direction transverse to the unwinding direction in accordance with the head-to-foot length of the book block.

6 Claims, 9 Drawing Sheets

(51) Int. Cl.
*B65H 35/00* (2006.01)
*B65H 35/02* (2006.01)
*B65H 35/08* (2006.01)
*B65H 37/04* (2006.01)

(52) U.S. Cl.
CPC ..... *B65H 35/02* (2013.01); *B65H 35/08* (2013.01); *B65H 37/04* (2013.01)

(58) Field of Classification Search
USPC ..... 412/3, 4, 5, 16, 19; 270/58.07, 58.08
See application file for complete search history.

(56) References Cited

U.S. PATENT DOCUMENTS

| | | | | |
|---|---|---|---|---|
| 3,527,632 | A | 9/1970 | Holes et al. | |
| 3,888,722 | A | 6/1975 | Blair et al. | |
| 4,166,300 | A | 9/1979 | Savich | |
| 4,177,410 | A * | 12/1979 | Dowd | B65H 35/02 242/412.3 |
| 5,211,383 | A * | 5/1993 | Valentinis | B65H 35/02 270/52.09 |
| 5,306,047 | A | 4/1994 | Otake et al. | |
| 5,894,978 | A * | 4/1999 | Welch | B26D 7/2628 83/564 |
| 6,006,807 | A * | 12/1999 | Domes | B42C 9/0056 156/538 |
| 6,460,843 | B1 * | 10/2002 | Dim | B42C 19/02 412/4 |
| 7,527,255 | B2 * | 5/2009 | Miyake | B42C 9/0018 270/58.11 |
| 8,858,148 | B2 * | 10/2014 | De Marco | B42C 11/045 283/64 |
| 8,882,099 | B2 * | 11/2014 | Lewalski | B65H 29/246 270/52.09 |
| 10,131,176 | B2 | 11/2018 | Thurnherr | |
| 2009/0078814 | A1 * | 3/2009 | Prittie | B26D 7/2635 242/525 |
| 2009/0279986 | A1 | 11/2009 | Rogalski, Jr. et al. | |
| 2010/0058907 | A1 * | 3/2010 | Kern | B26D 7/02 162/286 |
| 2011/0262248 | A1 * | 10/2011 | De Marco | B42C 9/02 412/33 |
| 2013/0101331 | A1 * | 4/2013 | Morrow | B41J 15/04 400/621 |
| 2020/0387100 | A1 * | 12/2020 | Takada | B65H 35/0086 |

FOREIGN PATENT DOCUMENTS

| | | | |
|---|---|---|---|
| DE | 10 2016 218 042 | A1 | 3/2018 |
| EP | 1 902 854 | A2 | 3/2008 |
| EP | 2 384 900 | A1 | 11/2011 |
| EP | 2 517 892 | A1 | 10/2012 |
| EP | 2 532 526 | A1 | 12/2012 |
| FR | 1527187 | | 5/1968 |
| GB | 1 480 505 | | 7/1977 |
| JP | 2014-198394 | A | 10/2014 |
| NL | 7410262 | | 10/1974 |

OTHER PUBLICATIONS

Extended European Search Report for European Application No. 21175482.5 dated Oct. 25, 2021.
Extended European Search Report for European Application No. 21175482.5 dated Oct. 26, 2021.
U.S. Appl. No. 17/333,102, filed May 28, 2021.

* cited by examiner

ADDITIONAL MEMBER ATTACHING APPARATUS AND BINDING SYSTEM INCLUDING THE SAME

CROSS-REFERENCE TO RELATED APPLICATIONS

This application is based on Japanese Patent Application No. 2020-96845, filed in Japan on Jun. 3, 2020; and Japanese Patent Application No. 2021-72668 filed in Japan on Apr. 22, 2021, the contents of which are incorporated herein by reference in their entirety.

BACKGROUND

1. Technical Field

The present disclosure relates to an additional member attaching apparatus configured to supply an additional member from outside of the binder and attach the additional member to a glue-applied spine of the book block standing still and upright at an additional member attaching position inside the binder and relates to a binding system including the additional member attaching apparatus.

2. Description of Related Art

A perfect binder including a cheesecloth supply apparatus is known from a related art (for example, see Japanese Patent Application Laid-Open No. 2014-198394). Such a perfect binder includes a clamper that can clamp a book block standing upright and move along a predetermined path, a series of processing units (a milling unit, a pasting unit, and a case making unit) that are arranged along the path and perform a perfect binding process, and a book block supply unit that supplies a book block to the clamper at a book block supply position on the upstream of the series of processing units located on the path.

The case making unit has a pressing plate and a pair of nip plates provided on the upper face of the pressing plate. A case supply unit has a case placement shelf on which a case is placed and a case transport mechanism that transports the case from the case placement shelf onto the pressing plate and the pair of nip plates of the case making unit.

Once a binding process is started, a case is transported from the case placement shelf onto the pressing plate and the pair of nip plates of the case making unit by a case transport mechanism. Then, when a book block clamped by the clamper reaches and stops at a predetermined position above the pressing plate and the pair of nip plates, the pressing plate and the pair of nip plates are raised to a nip position, the case is pressed against the book block spine by the pressing plate, both sides of the book block spine are then clamped by the pair of nip plates, thereby the case is pressed against both sides of the book block spine, the case is attached to the book block, and a bound book is completed.

As discussed above, such a binder can implement binding of a paper back. On the other hand, when such a binder is used for a hard cover book (for forming a book block of a hard cover book), the case supply unit is not used, and the cheesecloth supply apparatus is used instead.

The cheesecloth supply apparatus includes a cheesecloth forming unit that forms a strip of cheesecloth in accordance with the shape of the book block and a transport unit that transports the strip of cheesecloth from the cheesecloth forming unit to the case making unit of the binder and supplies the strip of cheesecloth onto the pair of nip plates of the case making unit with the strip of cheesecloth being placed across these nip plates.

The cheesecloth forming unit includes a roll of a continuous sheet of cheesecloth, a drive unit that rotates the roll to feed the continuous sheet of cheesecloth out onto the placement stage, and first and second cutters that cut and trim, in the longitudinal direction and the width direction, the continuous sheet of cheesecloth fed out by the drive unit.

The first cutter is configured to be movable in the width direction of a continuous sheet of cheesecloth and cuts the cheesecloth in the longitudinal direction in accordance with the thickness of the book block. Further, in accordance with the head-to-foot length of the book block, the second cutter trims, in the width direction, the cheesecloth cut by the first cutter and positioned on the placement stage.

The transport unit has a suction tool that sucks a strip of cheesecloth placed on the placement stage and a rail extending from the placement stage to the case making unit.

The rail extends from above of the placement stage to above of the book block clamped by the clamper stopped above the pressing plate and the pair of nip plates of the case making unit, and the suction tool is mounted to the rail movably along the rail.

In such a binder, when a book block of a hard cover book is formed, first, a strip of cheesecloth in accordance with the size of the book block is formed in the cheesecloth forming unit of the cheesecloth supply apparatus. Subsequently, this strip of cheesecloth is supplied onto the pair of nip plates of the case making unit of the perfect binder by the transport unit of the cheesecloth supply apparatus with the strip of cheesecloth being placed across the nip plates.

In the book block supply position of the perfect binder, the book block is then supplied to the clamper, and the clamper clamping the book block reaches and stops at a predetermined position above the pressing plate and the pair of nip plates of the case making unit via the milling unit and the pasting unit.

Further, the pressing plate and the pair of nip plates are raised, the strip of cheesecloth is pressed against the book block spine by the pressing plate, both sides of the book block spine are then clamped by the pair of nip plates, thereby the strip of cheesecloth is pressed against both sides of the book block spine, and the strip of cheesecloth is attached to the book block spine.

As discussed above, according to the perfect binder including such a cheesecloth supply apparatus, since it is possible to form a strip of cheesecloth in accordance with the size of a book block and attach the strip of cheesecloth to the book block spine, this enables quick preparation even for a case of binding hard cover books from a plurality of book blocks having different sizes.

According to the above configuration, when a strip of cheesecloth is formed from a continuous sheet of cheesecloth, the continuous sheet of cheesecloth is first trimmed in the longitudinal direction of the cheesecloth in accordance with the thickness of a book block and then cut in the width direction of the cheesecloth in accordance with the head-to-foot length of the book block.

However, since the head-to-foot length of a book block is larger than the thickness thereof in general, trimming and cutting a continuous sheet of cheesecloth as described above generates a large amount of scraps and causes a problem of increased production cost due to wasteful consumption of the material (cheesecloth).

Further, according to the above configuration, the first cutter having roll blades is arranged upstream, the second cutter having a straight blade is arranged downstream, trimming by the first cutter is performed during a continuous sheet of cheesecloth being unwound and drawn by a predetermined length (a length adapted to the length of a book block spine), the operation of unwinding the cheesecloth is then temporarily stopped, and cutting by the second cutter is performed.

When the book block size is changed, the unwinding length of a continuous sheet of cheesecloth is changed in accordance with the change of the head-to-foot length of the book block, and the position of the roll blades of the first cutter is changed in the width direction of the continuous sheet of cheesecloth in accordance with the change of the thickness of the book block.

In such a case, however, since the first cutter performs trimming while the continuous sheet of cheesecloth is unwound and drawn, when the position of the blade of the first cutter is changed during an operation of the apparatus, cheesecloth unwound and drawn during such a position change will be cut wastefully. Thus, unwinding of the continuous sheet of cheesecloth is required to be stopped until the position change of the roll blade of the first cutter is completed.

That is, according to such a configuration, there is a problem of reduced productivity, because every time the book block size is changed, the operation of the cheesecloth supply apparatus is stopped, the position of the roll blade of the first cutter is set, and the operation of the cheesecloth supply apparatus is restarted after completion of the position setting.

BRIEF SUMMARY

Therefore, the object of the present disclosure is to provide an additional member attaching apparatus that supplies and attaches an additional member such as cheesecloth and may suppress wasteful consumption of a material and to provide a binding system including the additional member attaching apparatus.

Further, another object of the present disclosure is to provide an additional member attaching apparatus that supplies and attaches an additional member such as cheesecloth and enables a size change of book blocks without stopping an operation of the additional member attaching apparatus and to provide a binding system including the same.

To achieve the objects described above, an additional member attaching apparatus according to one aspect of the present disclosure is an additional member attaching apparatus connected to a binder and configured to supply an additional member from outside of the binder and attach the additional member to a glue-applied spine of a book block stopped at an additional member attaching position inside the binder, and the additional member attaching apparatus includes: a roll accommodation unit that accommodates a roll of a continuous sheet of the additional member rotatably about an axis; an unwinding unit that unwinds and draws the continuous sheet of additional member from the roll accommodation unit to a trimming station; and a trimming unit that is arranged in the trimming station and cuts and trims the continuous sheet of additional member unwound and drawn by the unwinding unit in accordance with a size of the book block to form a strip of additional member. The trimming unit has a first cutter that cuts the continuous sheet of additional member, which was unwound and drawn by the unwinding unit, in a direction transverse to an unwinding direction by a length in accordance with a thickness of the book block, and a second cutter that trims the additional member, which was cut by the first cutter, in the unwinding direction in accordance with a head-to-foot length of the book block.

The additional member attaching apparatus according to one aspect of the present disclosure includes a control unit that controls the unwinding unit so as to intermittently unwind and draw the continuous sheet of additional member by a length in accordance with the thickness of the book block.

In the additional member attaching apparatus according to one aspect of the present disclosure, the control unit controls the first cutter in synchronization with the unwinding unit that intermittently operates.

In the additional member attaching apparatus according to one aspect of the present disclosure, the control unit controls a position of the second cutter so that the position corresponds to a head-to-foot length of the book block.

The additional member attaching apparatus according to one aspect of the present disclosure includes an additional member transfer and attaching unit that, in a state where the additional member attaching apparatus is connected to the binder, transfers the strip of additional member to the additional member attaching position inside the binder and attaches the strip of additional member to the spine of the book block stopped at the additional member attaching position.

In the additional member attaching apparatus according to one aspect of the present disclosure, the first cutter has a straight blade extending above an unwinding path of a continuous sheet of additional member and across the unwinding path and configured to move vertically, a blade rest plate arranged facing the straight blade under the unwinding path, and a straight blade drive mechanism configured to cause the straight blade to move between a standby position where the straight blade is distant from the blade rest plate by a predetermined distance and a cutting position where the straight blade engages with the blade rest plate. The second cutter has at least one slide guide extending across the transport path of the transport mechanism, a blade holder mounted slidably to the at least one slide guide, a holder drive mechanism configured to move the blade holder to slide, a pair of roll blades mounted to the blade holder such that the pair of roll blades face each other vertically interposing the transport path and are rotatable about respective shafts extending across the transport path, and a rotation drive mechanism coupled to at least one of the shafts of the pair of roll blades.

In the additional member attaching apparatus according to one aspect of the present disclosure, the trimming unit further has a stopper extending across the transport path on the downstream of the second cutter on transport path and configured to stop the strip of additional member when a leading end of the strip of additional member transported on the transport path comes into contact with the stopper.

In the additional member attaching apparatus according to one aspect of the present disclosure, the book block stopped at the additional member attaching position stands upright, the additional member transfer and attaching unit has a gripper configured to grip the strip of additional member while supporting an under face of the strip of additional member, a first gripper drive mechanism configured to cause the gripper to move between a retracted position inside the apparatus and a forward position outside the apparatus, a second gripper drive mechanism configured to cause the gripper to move between the forward position and a raised position above the forward position, and a handover unit configured to hand over the strip of the additional member from the trimming station to the gripper in the retracted position. In a state where the additional member attaching apparatus is connected to the binder, the forward position of the gripper is right under the spine of the book block stopped at the additional member attaching position inside the binder, and the gripper in the raised position presses the strip of additional member against the spine of the book block.

A binding system according one aspect of the present disclosure includes: the additional member attaching apparatus according to any of the aspects described above; and a binder to which the additional member attaching apparatus is connected.

The first cutter that cuts, in a direction transverse to the unwinding direction, a continuous sheet of additional member unwound and drawn by a length in accordance with the thickness of a book block is arranged at the input port of the trimming station. The transport mechanism that transports the cut additional member from the first cutter out in the unwinding direction of the continuous sheet of additional member is arranged downstream of the first cutter. The second cutter that trims, in the unwinding direction, the cut additional member transported on the transport path is arranged in the transport path of the transport mechanism. The position of the blades of the second cutter may be adjusted in the direction transverse to the unwinding direction in accordance with the head-to-foot length of the book block.

In such a way, a continuous sheet of additional member is cut in the direction transverse to the unwinding direction of the continuous sheet of additional member (the width direction of the continuous sheet of additional member) in accordance with the thickness of the book block, and the cut additional member is then trimmed in the unwinding direction in accordance with the head-to-foot length of the book block. Thus, it is possible to minimize the amount of scraps and accordingly suppress wasteful consumption of a material (additional member).

Further, during an operation of the apparatus, the first cutter performs a cutting operation intermittently in synchronization with the intermittent unwinding operation of a continuous sheet of additional member performed by the unwinding unit, and the second cutter trims the additional member cut by the first cutter while the additional member is transported by the transport mechanism from the first cutter.

Further, when the book block size is changed during the operation of the apparatus, size information on a new book block is simultaneously transmitted from the control unit of the apparatus to the transport mechanism and the first and second cutters, the unwinding amount of the continuous sheet of additional member drawn by the unwinding unit is changed based on the size information, and the position of the blades of the second cutter is changed.

In such a case, by performing the position change of the blades of the second cutter within a period from the time the unwinding by the unwinding unit is started to the time the additional member cut by the first cutter reaches the second cutter, it is possible to change the book block size without stopping the operation of the apparatus.

DETAILED DESCRIPTION

Figure 1:
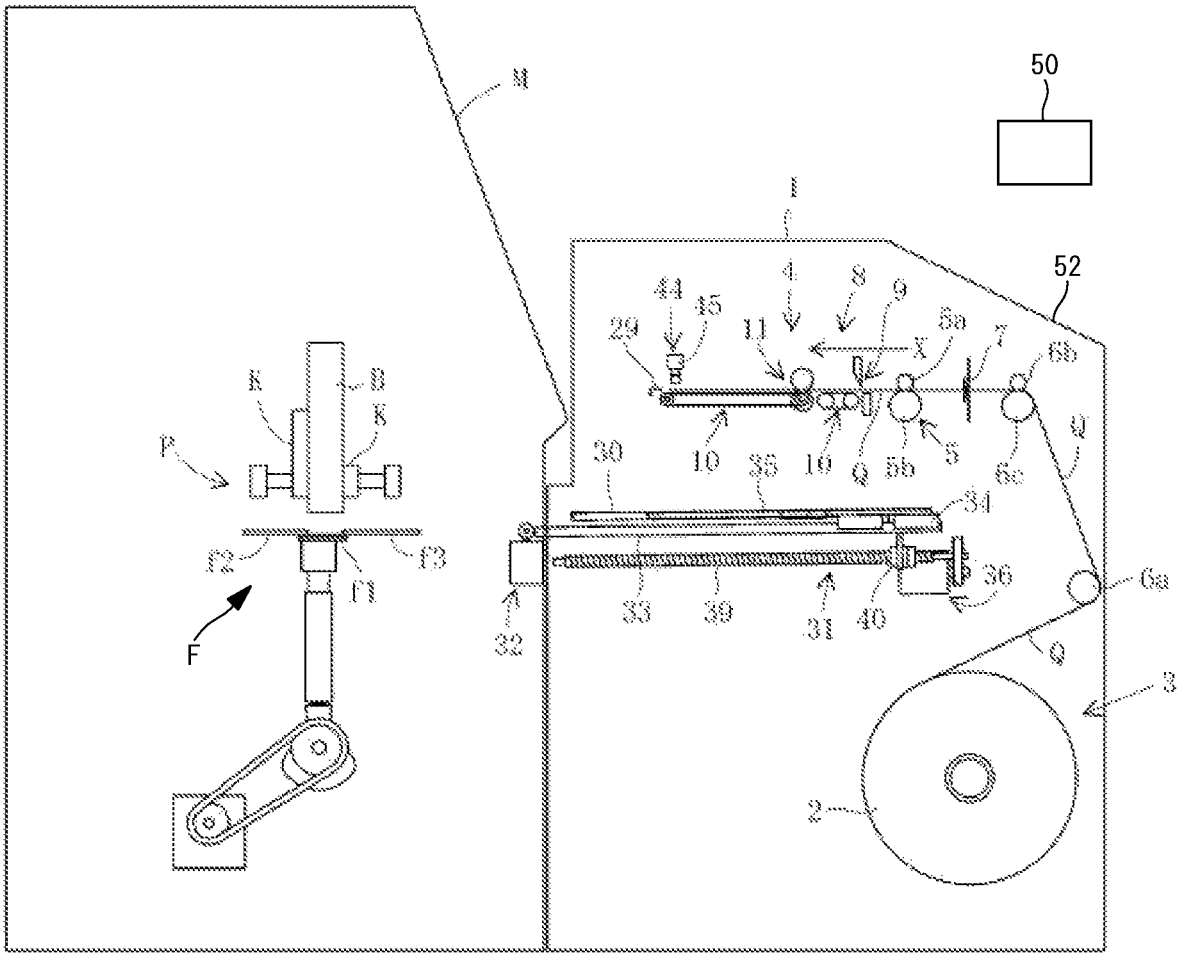
FIG. 1 illustrates a binding system according to a first embodiment of the present disclosure and is a side view schematically illustrating a configuration inside an additional member attaching apparatus.

The configuration of the present disclosure will be described below based on preferred embodiments with reference to the attached drawings. FIG. 1 is a side view schematically illustrating a configuration inside an additional member attaching apparatus that supplies and attaches an additional member to a book block spine according to first embodiment of the present disclosure.

FIG. 1 illustrates a binding system including a binder M and an additional member attaching apparatus 1, and the additional member attaching apparatus 1 is connected to the binder M. Further, in FIG. 1, for simplified illustration, only a suction head of a handover unit is depicted as a representative of the handover unit (details of the configuration thereof will be described later).

The additional member attaching apparatus 1 includes, inside a housing 52, a roll accommodation unit 3 that accommodates a roll 2 of a continuous sheet of additional member Q rotatably about the horizontal axis and an unwinding unit 5 that unwinds and draws a continuous sheet of additional member Q from the roll accommodation unit 3 to a trimming station 4. The operation of the unwinding unit 5 is controlled by a control unit 50.

As used herein, "additional member" refers to a sheet of member to be attached to a book block spine in a process for a hard cover book and may be, for example, cheesecloth, paper, or the like.

The unwinding unit 5 is formed of a pair of unwinding rollers 5*a* and 5*b* that may be driven and rotated about the horizontal axis, respectively.

Further, a guide roller 6*a* and a pair of guide rollers 6*b* and 6*c* are arranged between the roll accommodation unit 3 and the pair of unwinding rollers 5*a* and 5*b* and are rotatable about the horizontal axis, respectively. Note that the pair of guide rollers 6*b* and 6*c* may be configured to provide driving force such that reverse torque is applied in a direction opposite to the feed direction of the pair of unwinding rollers 5*a* and 5*b*. Thereby, tension can be applied to the additional member Q. When unwinding and drawing the additional member Q, the pair of the guide rollers 6*b* and 6*c* are rotated together in the transport direction by friction with the additional member Q while providing reverse torque thereto. However, when unwinding and drawing of the additional member Q is stopped, the reverse torque of the pair of guide rollers 6*b* and 6*c* is also stopped.

A continuous sheet of additional member Q unwound and drawn from the roll 2 is then introduced between the pair of unwinding rollers 5*a* and 5*b* via a part of the circumference surface of the guide roller 6*a* and a gap between the pair of guide rollers 6*b* and 6*c*. Then, every time the pair of unwinding rollers 5*a* and 5*b* are driven and rotated in response to an instruction from the control unit 50, a predetermined length of a continuous sheet of additional member Q is unwound and drawn from the roll 2 to the trimming station 4. The trimming station 4 is provided inside the housing 52.

Further, a curl remover 7 that restricts a curl of a continuous sheet of additional member Q is arranged between the pair of guide rollers 6*b* and 6*c* and the pair of unwinding rollers 5*a* and 5*b*.

The additional member attaching apparatus 1 further includes a trimming unit 8 that is arranged in the trimming station 4 and cuts and trims a continuous sheet of additional member Q unwound and drawn by the unwinding unit 5 in accordance with the size of a book block B to form a strip of additional member S.

Figure 2A:
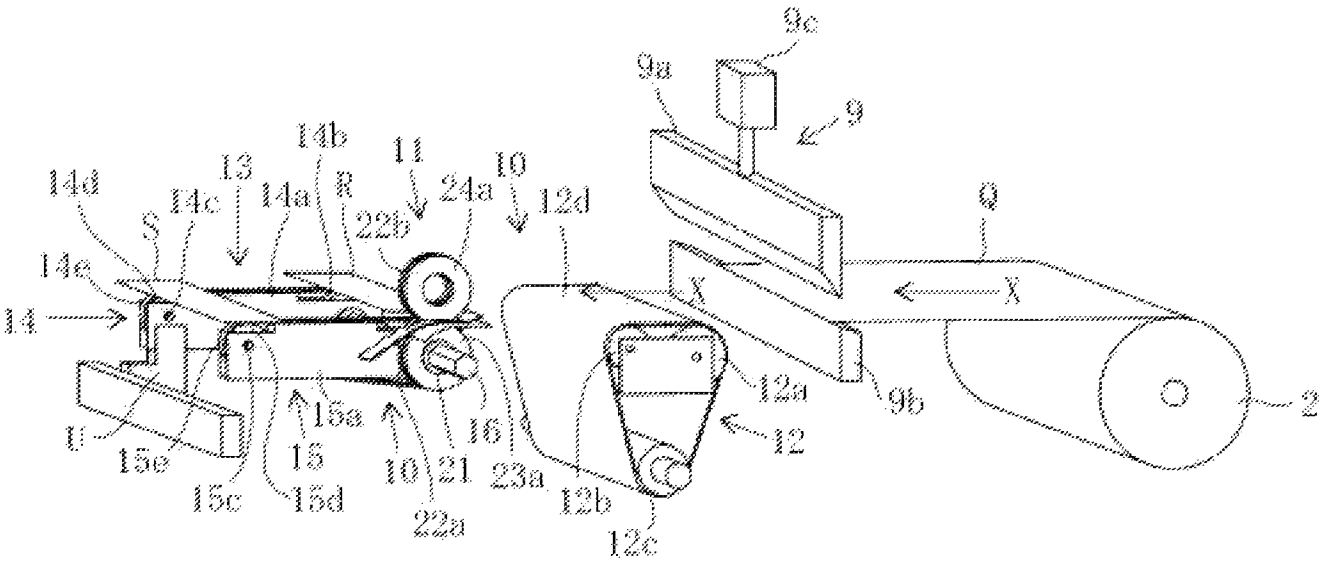
FIG. 2A is a perspective view schematically illustrating a configuration of a trimming unit of the apparatus of FIG. 1.
Figure 2B:
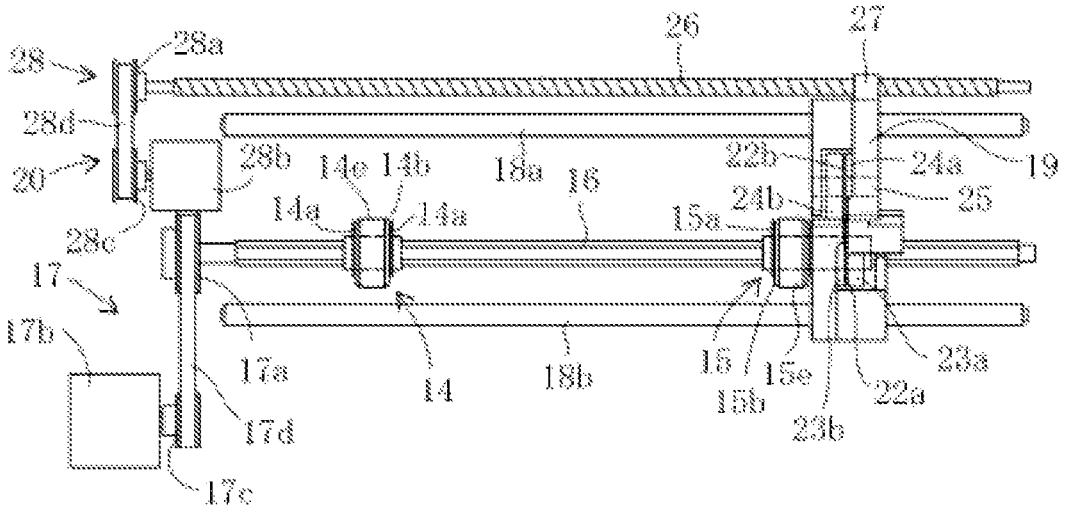
FIG. 2B is a diagram of a part near a second cutter of FIG. 2A when viewed from the downstream of a transport direction.

FIG. 2A is a perspective view schematically illustrating a configuration of a trimming unit. FIG. 2B is a diagram of a part near a second cutter of FIG. 2A when viewed from the downstream of a transport direction.

As shown in FIG. 2A and FIG. 2B, the trimming unit 8 is arranged at the input port of the trimming station 4 and has a first cutter 9 that cuts, in a direction transverse to the unwinding direction (indicated by the arrow X), a continuous sheet of additional member Q unwound by a length in accordance with the thickness of the book block B by the unwinding unit 5, a transport mechanism 10 that transports the cut additional member R from the first cutter 9 out in the unwinding direction (arrow X), and a second cutter 11 that is arranged in the transport path of the transport mechanism 10 and trims, in the unwinding direction (arrow X), the cut additional member R transported on the transport path. The operation of the first cutter 9, the transport mechanism 10, and the second cutter 11 is controlled by the control unit 50.

The first cutter 9 has a straight blade 9*a* extending across the unwinding path above the unwinding path of the continuous sheet of additional member Q and configured to be movable in the vertical direction, a blade rest plate 9*b* arranged facing the straight blade 9*a* under the unwinding path, and a straight blade drive mechanism 9*c* configured to cause the straight blade 9*a* to move between a standby position distant by a predetermined distance from the blade rest plate 9*b* and a cutting position engaged with the blade rest plate 9*b*.

The transport mechanism 10 includes an upstream conveyer belt 12 located upstream in the unwinding direction (arrow X) and a downstream conveyer belt 13 located downstream of the upstream conveyer belt 12. The upstream conveyer belt 12 is formed of a pair of horizontal idle rollers 12*a* and 12*b* arranged spaced apart from each other in the unwinding direction (arrow X) and extending across the unwinding direction (arrow X), respectively, a driving roller 12*c* arranged under the pair of idle rollers 12*a* and 12*b* and extending parallel to the pair of idle rollers 12*a* and 12*b*, an endless belt 12*d* hung between the pair of idle rollers 12*a* and 12*b* and the driving roller 12*c*, and a rotation drive mechanism (not illustrated) configured to rotate the driving roller 12*c*.

The downstream conveyer belt 13 has a fixed side conveyer belt 14 and a movable side conveyer belt 15 arranged spaced apart from each other in the direction transverse to the unwinding direction (arrow X) and extending in the unwinding direction (arrow X), respectively.

The fixed side conveyer belt 14 has a conveyer frame 14*a* extending in the unwinding direction (arrow X) and having a U-shape cross section, a drive shaft 16 penetrating and extending through the upstream portion of a pair of side walls of the conveyer frame 14*a* in the direction transverse to the unwinding direction (arrow X), configured to be rotatable about the axis thereof, and having a regular hexagonal cross section, a driving roller 14*b* having a regular hexagonal through hole corresponding to the cross section of the drive shaft 16 formed along the center axis and fit into the drive shaft 16 while being arranged between the pair of side walls of the conveyer frame 14*a*, a shaft 14*c* parallel to the drive shaft 16 and fixed between the pair of side walls of the conveyer frame 14*a* on the downstream of the drive shaft 16, an idle roller 14*d* mounted to the shaft 14*c*, and an endless belt 14*e* hung between the driving roller 14*b* and the idle roller 14*d*.

The fixed side conveyer belt 14 is fixed to a frame of the additional member attaching apparatus 1 in the conveyer frame 14*a*. Therefore, contrary to the movable side conveyer belt 15, the fixed side conveyer belt 12 does not slide along the drive shaft 16.

The movable side conveyer belt 15 has a conveyer frame 15*a* extending in the unwinding direction (arrow X) and having a U-shape cross section, and the drive shaft 16 penetrates through the upstream portion of a pair of side walls of the conveyer frame 15*a*.

That is, the drive shaft 16 serves as a drive shaft common to the fixed side conveyer belt 14 and the movable side conveyer belt 15.

The movable side conveyer belt 15 further has a driving roller 15*b* having a regular hexagonal through hole corresponding to the cross section of the drive shaft 16 formed along the center axis and fit into the drive shaft 16 while being arranged between the pair of side walls of the conveyer frame 15*a*, a shaft 15*c* parallel to the drive shaft 16 and fixed between the pair of side walls of the conveyer frame 15*a* on the downstream of the drive shaft 16, an idle roller 15*d* mounted to the shaft 15*c*, and an endless belt 15*e* hung between the driving roller 15*b* and the idle roller 15*d*.

The movable side conveyer belt 15 is mounted to the blade holder (described later) of the second cutter in the conveyer frame 15*a* and can slide along the drive shaft 16 together with the blade holder.

The downstream conveyer belt 13 further has a drive mechanism 17 that rotates the drive shaft 16.

The drive mechanism 17 has a pulley 17*a* fixed at an end of the drive shaft 16 on the fixed side conveyer belt side, a motor 17*b* having a drive shaft that is arranged under the pulley 17*a* and is parallel to the drive shaft 16, a pulley 17*c* fixed to the drive shaft of the motor 17*b*, and an endless belt 17*d* hung between the pulley 17*a* and the pulley 17*c*.

The transport path of the transport mechanism 10 is formed of a transport plane of the upstream conveyer belt 12 and a plane including transport planes of the fixed side and movable side conveyer belts 14 and 15 of the downstream conveyer belt 13.

As illustrated in FIG. 1, the trimming unit 8 further has a stopper 29 extending across the transport path at the downstream end of the transport path of the transport mechanism 10 (the downstream conveyer belt 13) and configured to stop a strip of additional member S when the leading end of the strip of additional member S transported on the transport path comes into contact with the stopper 29.

As illustrated in FIG. 2B, the second cutter 11 has two slide guides 18*a* and 18*b* arranged above and below the transport path of the transport mechanism 10 (the downstream conveyer belt 13) and extending in parallel to each other across the transport path, a blade holder 19 extending vertically across the two slide guides 18*a* and 18*b* and mounted to the slide guides 18*a* and 18*b* in a slidably manner, and a holder drive mechanism 20 configured to slide the blade holder 19.

A roll blade accommodating space having a rectangular cross section extending vertically is formed inside the blade holder 19, and a sleeve 21 extending in the direction transverse to the transport path is mounted rotatably about a shaft via a bearing (not illustrated) between a pair of side walls of the blade holder 19 defining the roll blade accommodating space. The sleeve 21 has a regular hexagonal insertion hole extending along the center axis and corresponding to the cross section of the drive shaft 16 of the downstream conveyer belt 13, and the drive shaft 16 of the downstream conveyer belt 13 penetrates and extends through the insertion hole of the sleeve 21.

The second cutter 11 further has a pair of roll blades 22*a* and 22*b* arranged between the pair of side walls of the blade holder 19 and arranged interposing the transport path and facing each other in the vertical direction. The roll blade 22*a* is interposed between a pair of feed rollers 23*a* and 23*b* and fixed to the pair of feed rollers 23*a* and 23*b* in a coaxial manner, and the roll blade 22*b* is interposed between a pair of feed rollers 24*a* and 24*b* and fixed to the pair of feed rollers 24*a* and 24*b* in a coaxial manner.

The assembly of the roll blade 22*a* and the pair of feed rollers 23*a* and 23*b* has an assembly hole extending along the center axis and having a diameter corresponding to the diameter of the sleeve 21, is fit into the sleeve 21 between the pair of side walls, and is mounted to the sleeve 21 in an integral and rotatable manner.

Further, a shaft 25 extending in parallel to the sleeve 21 is fixed between the pair of side walls above the sleeve 21 in the blade holder 19. Further, the assembly of the roll blade 22*b* and the pair of feed rollers 24*a* and 24*b* is mounted to the shaft 25 coaxially and rotatably about the shaft 25 via a bearing (not illustrated) in arrangement such that the pair of feed rollers 24*a* and 24*b* face the pair of feed rollers 23*a* and 23*b* and the roll blade 22*b* engages with the other roll blade 22*a* between the pair of side walls.

As illustrated in FIG. 2B, the movable side conveyer belt 15 (conveyer frame 15*a*) of the downstream conveyer belt 13 is fixed to and supported by one of the pair of side walls of the blade holder 19.

The holder drive mechanism 20 has a ball screw 26 extending in parallel to the upper slide guide 18*a* and arranged rotatably about an axis at a fixed position, a ball screw nut 27 provided to the blade holder 19 and engaged with the ball screw 26, and a ball screw drive mechanism 28 configured to rotate the ball screw 26.

The ball screw drive mechanism 28 has a pulley 28*a* fixed to the end of the fixed side conveyer belt 14 side of the ball screw 26, a motor 28*b* having a drive shaft arranged below the pulley 28*a* and parallel to the ball screw 26, a pulley 28*c* fixed to the drive shaft of the motor 28*b*, and an endless belt 28*d* hung between the pulley 28*a* and the pulley 28*c*.

In such a way, the drive shaft 16 is rotated by the drive mechanism 17 (motor 17*b*), thereby the downstream conveyer belt 13 (fixed side and movable side conveyer belts 14 and 15) is driven and rotated, and at the same time, the pair of roll blades 22*a* and 22*b* of the second cutter 11 are driven and rotated. Further, the ball screw 26 of the holder drive mechanism 20 is rotated in the forward or reverse direction by the ball screw drive mechanism 28 (motor 28*b*), and thereby the blade holder 19 (pair of roll blades 22*a* and 22*b*) and the movable side conveyer belt 15 of the downstream conveyer belt 13 move in a direction transverse to the unwinding direction (arrow X).

The additional member attaching apparatus 1 further includes a gripper 30 that can grip a strip of additional member S while supporting the under face of the strip of additional member S. The additional member attaching apparatus 1 includes a first gripper drive mechanism 31 that causes the gripper 30 to move between a retracted position (see FIGS. 1 and 4A) inside the housing 52 and a forward position (see FIG. 4B) outside the housing 52 and a second gripper drive mechanism 32 that causes the gripper 30 to move between the forward position and a raised position (see FIG. 5A) above the forward position. The operation of the first gripper drive mechanism 31 and the second gripper drive mechanism 32 is controlled by the control unit 50.

Further, the components of the gripper 30 and the first and second gripper drive mechanisms 31 and 32 and the components of the trimming unit 8 are arranged vertically in two stages in the arrangement such that the trimming unit 8 is on the upper stage. The gripper 30 is located inside the housing 52 when the retracted position is applied and expands outside the housing 52 when the forward position is applied. The first gripper drive mechanism 31 has a main part arranged inside the housing 52, and the leading end side projects outside the housing 52 when the forward position is applied. The second gripper drive mechanism 32 is provided near outside of the housing 52. Therefore, as illustrated in FIG. 1, when the additional member attaching apparatus 1 is connected to the binder M, the second gripper drive mechanism 32 will be located inside the binder M. However, the second gripper drive mechanism 32 may be provided inside the housing 52.

Figure 3:
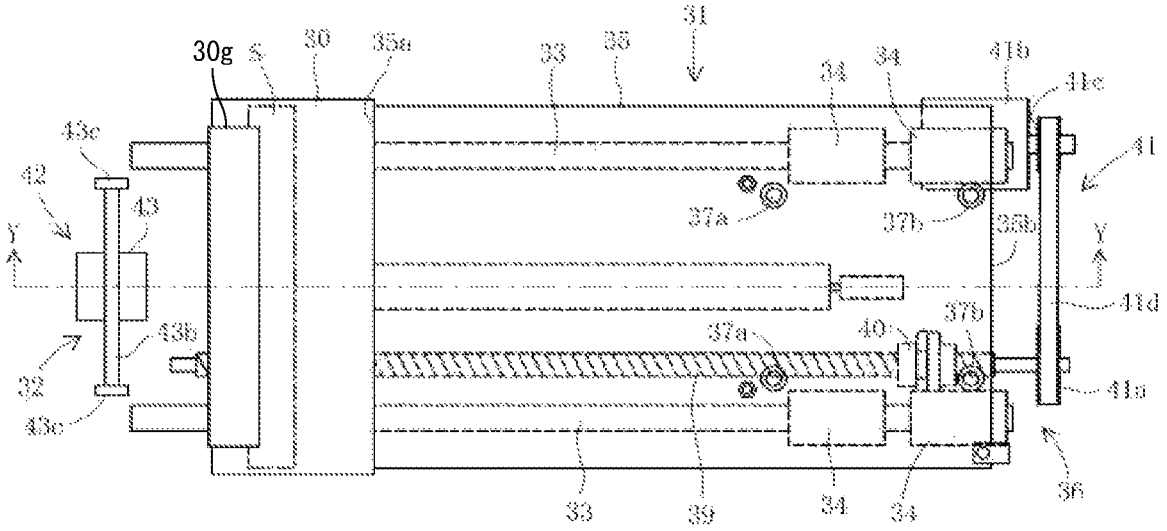
FIG. 3 is a plan view of a gripper and first and second gripper drive mechanisms of the apparatus of FIG. 1.

FIG. 3 is a plan view of the gripper 30 and the first and second gripper drive mechanisms 31 and 32 of the additional member attaching apparatus 1 of FIG. 1. Further, FIG. 4 and FIG. 5 each are a sectional view taken along the line Y-Y of FIG. 3, which illustrate the operation of the gripper 30 and the first and second gripper drive mechanisms 31 and 32 of FIG. 3.

The gripper 30 includes a gripping portion 30*g* that grips a strip of additional member S. The gripping portion 30*g* is able to come close to and move away from the placement face of the gripper 30 on which a strip of additional member S is placed and temporarily fixes the additional member S by pressing the additional member S against the placement face. The operation of the gripping portion 30*g* is controlled by the control unit 50.

Referring to FIG. 3 to FIG. 5B, the first gripper drive mechanism 31 has at least one (two in this example) slide guide(s) 33 extending from inside to outside of the housing 52 and inclined downward, sliders 34 mounted to respective slide guides 33, a planar arm 35 extending in parallel to the slide guides 33, mounted to the upper face of the sliders 34, configured to be swingable about a rear end edge 35*b* as a spindle, and having a leading end 35*a* to which the gripper 30 is mounted, and a slider drive mechanism 36 configured to cause the sliders 34 to move between a recessed position where the gripper 30 is arranged in the retracted position and a projected position where the gripper 30 is arranged in a forward position.

The arm 35 is mounted to each slider 34 by using a pair of flanged pins 37*a* and 37*b* inserted through a pair of through holes, respectively, which are provided on both sides of the arm 35 with a spacing in the front-rear direction, and fixed to the slider 34, a compression spring 38*a* arranged between the arm 35 and a flange of the front side flanged pin 37*a* out of the pair of flanged pins 37*a* and 37*b*, and a compression spring 38*b* arranged between the arm 35 and a flange of the rear side flanged pin 37*b* out of the pair of flanged pins 37*a* and 37*b*. The front side compression spring 38*a* has a smaller elastic modulus than the rear side compression spring 38*b*.

The slider drive mechanism 36 has a ball screw 39 extending in parallel to the slide guide 33 and arranged rotatably about an axis at a fixed position, a ball screw nut 40 provided to the slider 34 and engaged with the ball screw 39, and a ball screw drive mechanism 41 configured to rotate the ball screw 39 about the axis.

The ball screw drive mechanism 41 is formed of a pulley 41*a* fixed to the rear end of the ball screw 39, a motor 41*b* arranged below the pulley 41*a* such that the drive shaft is parallel to the ball screw 39, a pulley 41*c* fixed to the drive shaft of the motor 41*b*, and an endless belt 24*d* hung between the pulley 41*a* and the pulley 41*c*.

Further, when the ball screw 39 is rotated in the forward or reverse direction by the ball screw drive mechanism (motor 41*b*), the slider 34 slides along the slide guide 33.

The second gripper drive mechanism 32 is formed of an arm drive mechanism 42 that causes the arm 35 to swing about the rear end edge 35*b* (spindle) of the arm 35 between the horizontal position and an inclined position inclined downward from the horizontal position (extending in parallel to the slide guide 33).

The arm drive mechanism 42 is formed of an air cylinder 43 arranged in front of the projected position of the slider 34 and under the arm 35 and extending vertically, a horizontal support shaft 43*b* is mounted to the tip of a piston rod 43*a* of the air cylinder 43 and extends in a direction transverse to the transport path, and a roller 43*c* is mounted at both ends of the support shaft 43*b* rotatably about the support shaft 43*b*.

Further, the piston rod 43*a* of the air cylinder 43 reciprocates between the first position where the roller 43*c* is recessed below the inclined position of the arm 35 and the second position where the roller 43*c* projects above from the inclined position of the arm 35.

In such a way, while the piston rod 43*a* of the air cylinder 43 is normally at the first position, the piston rod 43*a* moves from the first position to the second position when the slider 34 enters the projected position, and thereby the arm 35 swings from the inclined position to the horizontal position. Subsequently, the piston rod 43*a* returns from the second position to the first position, and thereby the arm 35 swings from the horizontal position to the inclined position.

The additional member attaching apparatus 1 further has a handover unit 44 that hands over a strip of additional member S from the trimming station 4 (a stopping position at the downstream end of the transport path of the transport mechanism 10) to the gripper 30 located in the retracted position. The operation of the handover unit 44 is controlled by the control unit 50.

Figure 6:
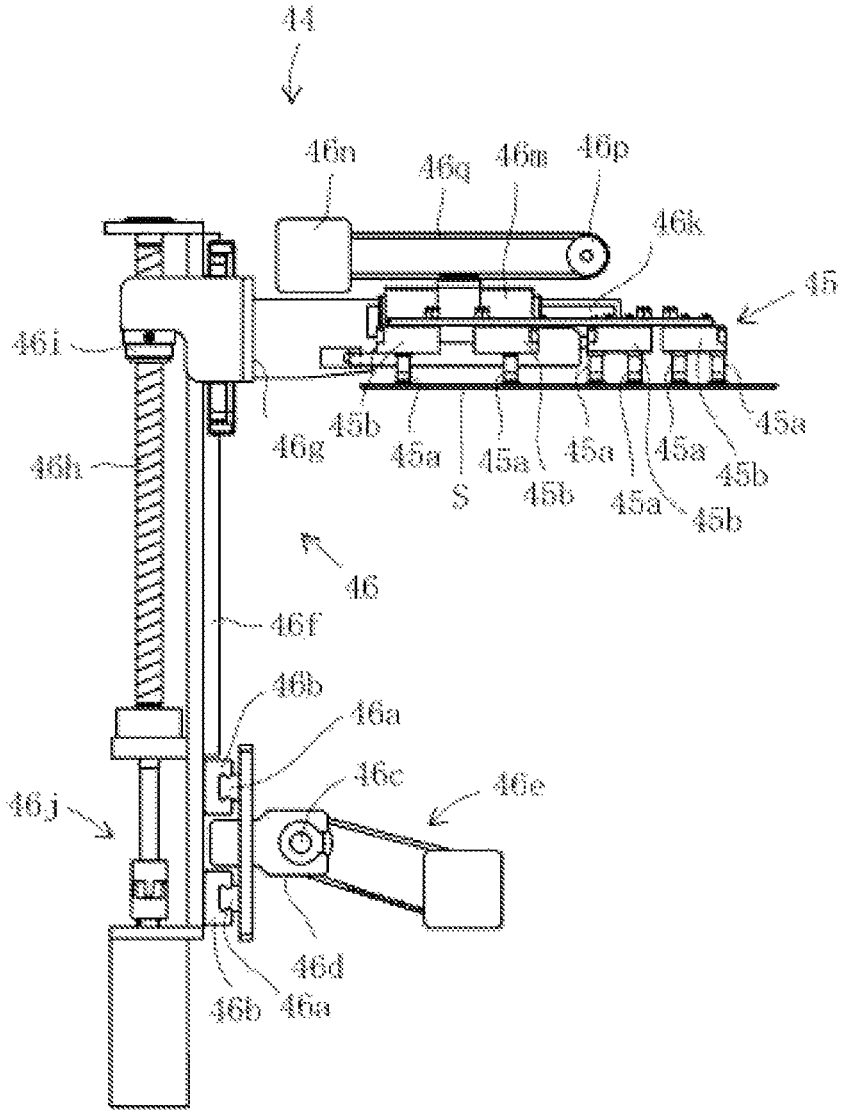
FIG. 6 is a front view of a handover unit of the apparatus of FIG. 1.

FIG. 6 is a front view of the handover unit (a view when viewed in the arrow X direction of FIG. 1).

As illustrated in FIG. 6, the handover unit 44 has a suction head 45 that can suck a strip of additional member S and a suction head drive mechanism 46 that causes the suction head 45 to move between the trimming station 4 (a stopping position of the strip of additional member S) and the gripper 30 at the retracted positions.

The suction head 45 has a plurality of suction cups 45*a* and a negative pressure generation unit 45*b* that causes each suction cup 45*a* to generate suction force.

The suction head drive mechanism 46 has a first slide guide 46*a* extending in the horizontal direction and along the slide guide 33 of the first gripper drive mechanism 31, a first slider 46*b* mounted to the first slide guide 46*a*, a first ball screw 46*c* extending in parallel to the first slide guide 46*a* and arranged rotatably about an axis at a fixed position, a first ball screw nut 46*d* mounted to the first slider 46*b* and engaged in the first ball screw 46*c*, and a first rotation drive mechanism 46*e* configured to rotate the first ball screw 46*c*.

The suction head drive mechanism 46 further has a second slide guide 46*f* mounted to the first slider 46*b* and extending vertically, a second slider 46*g* mounted to the second slide guide 46*f*, a second ball screw 46*h* mounted to the first slider 46*b*, extending in parallel to the second slide guide 46*f*, and configured to be rotatable about an axis at the fixed position, a second ball screw nut 46*i* mounted to the second slider 46*g* and engaged with the second ball screw 46*h*, and a second rotation drive mechanism 46*j* mounted to the first slider 46*b* and configured to rotate the second ball screw 46*h*.

The suction head drive mechanism 46 further has a third slide guide 46*k* mounted to the second slider 46*g* and extending horizontally, perpendicularly to the first slide guide 46*a*, a third slider 46*m* mounted to the third slide guide 46*k*, a motor 46*n* mounted to the second slider 46*g* and having a drive shaft (not illustrated) extending in parallel to the first slide guide 46*a*, a pulley 46*p* mounted to the second slider 46*g* and configured to be rotatable about an axis parallel to the drive shaft of the motor 46*n*, and an endless belt 46*q* hung between a pulley (not illustrated) mounted to the drive shaft of the motor 46*n* and the pulley 46*p* and having the third slider 46*m* fixed thereto.

Further, the suction head 45 is mounted to the third slider 46*m* in arrangement such that the plurality of suction cups 45*a* face downward and are aligned on a straight line along the third slide guide 46*k*.

In such a way, when the first ball screw 46*c* is rotated in the forward or reverse direction by the first rotation drive mechanism 46*e*, the suction head 45 moves in a direction to come close to or move away from the gripper 30 in the trimming station 4 (a stopping position of the strip of additional member S) or in the retracted position. Further, when the second ball screw 46*h* is rotated in the forward or reverse direction by the second rotation drive mechanism 46*j*, the suction head 45 moves up and down. Further, when the endless belt 46*q* is rotated in the forward or reverse direction by the motor 46*n*, the suction head 45 moves in the longitudinal direction of a strip of additional member S.

The control unit 50 is formed of a central processing unit (CPU), a random access memory (RAM), a read only memory (ROM), a computer readable storage medium, and the like, for example. Further, a series of processes to implement various functions are stored in the storage medium or the like in a form of a program as an example, and various functions are implemented when the CPU reads such a program to the RAM or the like and performs processing of information or operational processing. Note that a form in which a program is installed in advance in a ROM or another storage medium, a form in which a program is provided in a state of being stored in a computer readable storage medium, a form in which a program is delivered via a wired or wireless communication scheme, or the like may be applied to the program. The computer readable storage medium may be a magnetic disk, a magneto-optical disk, a CD-ROM, a DVD-ROM, a semiconductor memory, or the like.

Next, the operation of the additional member attaching apparatus 1 will be described.

Referring again to FIG. 1, the additional member attaching apparatus 1 is connected to the binder M in the arrangement such that the forward position of the gripper 30 is right under the spine of the book block B stopped at the additional member attaching position P inside the binder M and that the gripper 30 in the raised position presses a strip of additional member S against the spine of the book block B.

Further, the position of the stopper 29 of the trimming unit 8 is adjusted and set so that a strip of additional member S stopped by the stopper 29 is arranged substantially in parallel to the spine of the book block B stopped at the additional member attaching position P of the binder M.

Note that, in this embodiment, the binder M is a perfect binder, the additional member attaching position P is a case making position of the perfect binder (the position right above a pressing plate f1 and a pair of nip plates f2 and f3 of a case making unit F), and the clamper K clamping the book block B standing upright is stopped at the case making position.

Prior to the operation of the additional member attaching apparatus 1, the size (the head-to-foot length and the thickness) of the book block B are input to the control unit 50 of the additional member attaching apparatus 1 through a control panel (not illustrated), initial setting of the additional member attaching apparatus 1 is performed based on the input values, and the operation of the additional member attaching apparatus 1 is then started.

The unwinding unit 5 then draws the continuous sheet of additional member Q by a length corresponding to the thickness of the book block B to the trimming station 4 (on the transport plane of the upstream conveyer belt 12) and stops. Subsequently, the straight blade 9*a* of the first cutter 9 moves down from the standby position to the cutting position and then moves up from the cutting position to the standby position. Accordingly, the continuous sheet of additional member Q is cut in its width direction.

The cut additional member R is transported from the first cutter 9 to the second cutter 11 and the downstream conveyer belt 13 by the upstream conveyer belt 12, then transported by the downstream conveyer belt 13, and introduced between the vertically facing feed rollers 23*a* and 24*a* and between vertically facing the feed rollers 23*b* and 24*b* of the second cutter 11 and between the pair of vertically facing roll blades 22*a* and 22*b*. Thereby, the additional member R cut by the first cutter 9 is trimmed into the length corresponding to the head-to-foot length of the book block B, and a strip of additional member S is formed.

The strip of additional member S is further transported downstream of the second cutter 11 and then comes into contact with the stopper 29 and stops on the transport path.

Figure 4A:
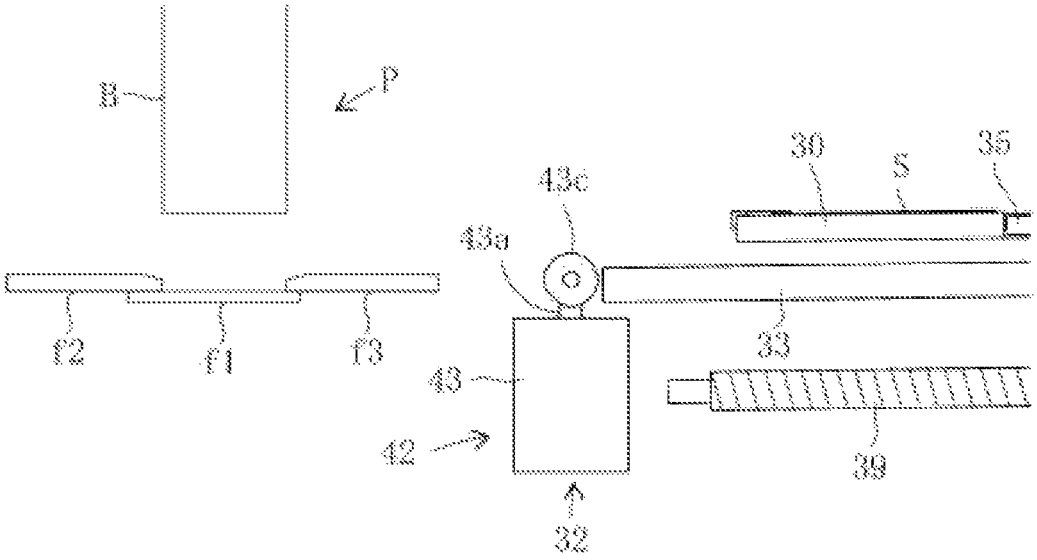
FIG. 4A illustrates the gripper and the first and second gripper drive mechanisms of the apparatus of FIG. 3 and is a sectional view taken along a line Y-Y of FIG. 3 when the gripper is in a retracted position.

The strip of additional member S is then transported from the trimming station 4 (the downstream end of the transport path of the transport mechanism 10) to the gripper 30 in the retracted position by the suction head 45 (the handover unit) and handed over to the gripper 30 (see FIG. 4A).

Figure 4B:
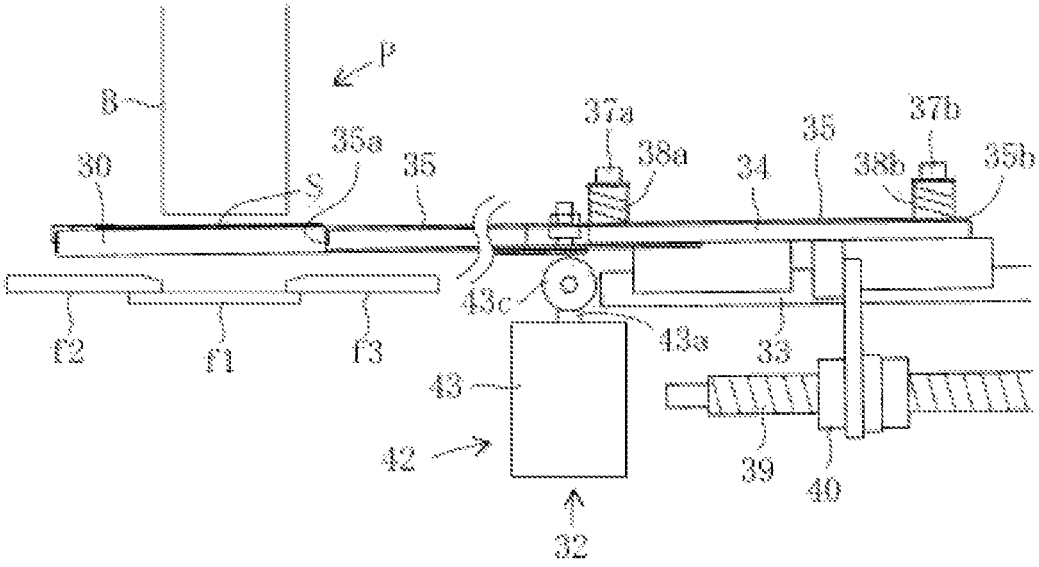
FIG. 4B is sectional view of the gripper in a forward position in comparison with FIG. 4A.

Next, the slider 34 slides toward the binder M while the arm 35 is maintained in the inclined position, and the gripper 30 enters the forward position while gripping the strip of additional member S (see FIG. 4B). At this time, the strip of additional member S (the gripper 30) is located right under a glue-applied spine of the book block B stopped at the additional member attaching position P.

Figure 5A:
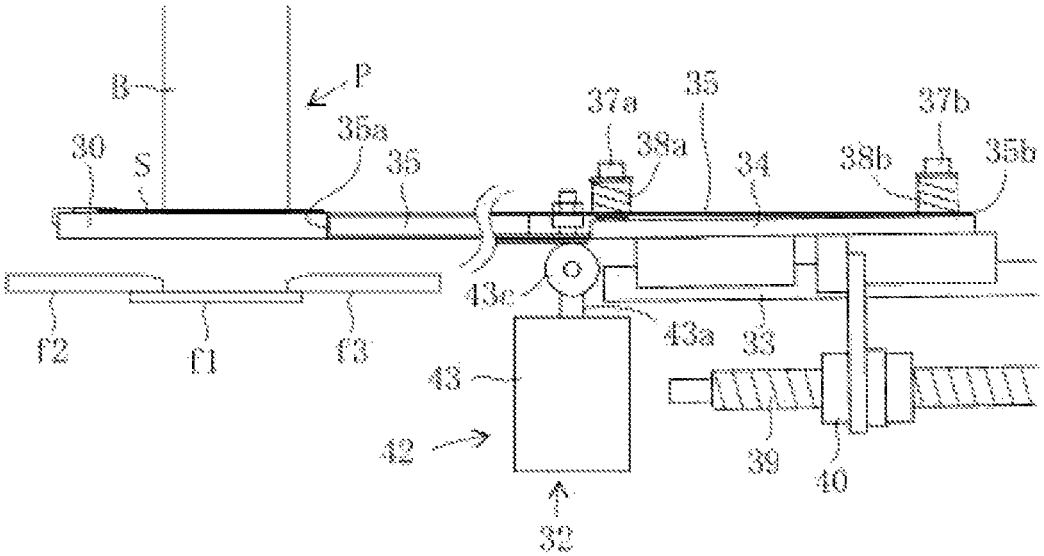
FIG. 5A illustrates the gripper and the first and second gripper drive mechanisms of FIG. 3 and is a sectional view taken along the line Y-Y of FIG. 3 when the gripper is in a raised position.
Figure 5B:
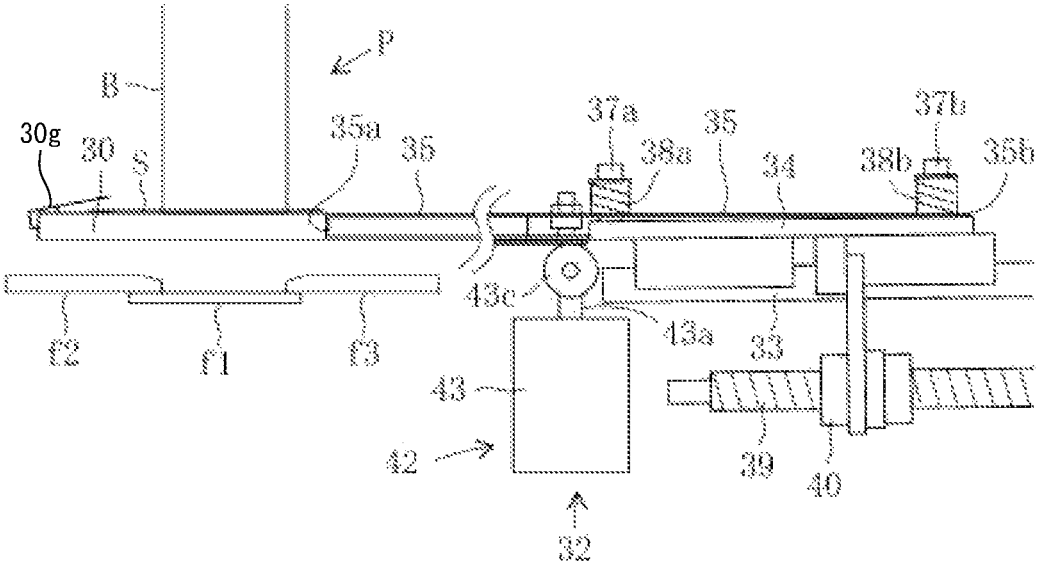
FIG. 5B illustrates a sectional view when the gripper has released a gripping portion at the raised position in comparison with FIG. 5A.

Subsequently, the arm 35 swings from the inclined position to the horizontal position, and thus the gripper 30 moves from the forward position to the raised position (see FIG. 5A). Thereby, the strip of additional member S is attached to the spine of the book block B. Then, after the gripper 30 releases the gripping of the strip of additional member S (see FIG. 5B), the arm 35 swings from the horizontal position to the inclined position, and attachment of the additional member is completed. The slider 34 then moves toward the additional member attaching apparatus 1 side, the gripper 30 enters the retracted position, and the next strip of additional member S is handed over to the gripper 30 by the suction head 45 (see FIG. 4A).

According to the present embodiment, the first cutter 9 that cuts, in the direction transverse to the unwinding direction (arrow X), a continuous sheet of additional member Q unwound and drawn by a length in accordance with the thickness of the book block B is arranged at the input port of the trimming station 4, the transport mechanism 10 that transports the cut additional member R from the first cutter 9 out in the unwinding direction of the continuous sheet of additional member (arrow X) is arranged downstream of the first cutter 9, the second cutter 11 that trims the cut additional member R being transported on the transport path in the unwinding direction (arrow X) is arranged in the transport path of the transport mechanism 10, and the position of the roll blades 22*a* and 22*b* of the second cutter 11 may be adjusted in the direction transverse to the unwinding direction (arrow X) in accordance with the head-to-foot length of the book block B.

In such a way, since a continuous sheet of additional member Q is cut in the direction (the width direction of the continuous sheet of additional member Q) transverse to the unwinding direction of the continuous sheet of additional member Q (arrow X) in accordance with the thickness of the book block B and, subsequently, the cut additional member R is trimmed in the unwinding direction (arrow X) in accordance with the head-tofoot length of the book block B, it is possible to minimize the amount of scraps, and it is thus possible to suppress wasteful consumption of a material (additional member).

Further, according to the present embodiment, during an operation of the additional member attaching apparatus 1, the first cutter 9 performs a cutting operation intermittently in synchronization with an intermittent operation of unwinding a continuous sheet of additional member Q performed by the unwinding unit 5, and the second cutter 11 trims the additional member R cut by the first cutter 9 while the additional member R is transported out from the first cutter 9 by the transport mechanism 10.

Further, when the size of the book block B is changed during the operation of the additional member attaching apparatus 1, size information on the new book block B is simultaneously transmitted from the control unit 50 of the additional member attaching apparatus 1 to the transport mechanism 10 and the first and second cutters 9 and 11, the unwinding amount of the continuous sheet of additional member Q caused by the unwinding unit 5 is changed based on the size information, and the position of the roll blades 22*a* and 22*b* of the second cutter 11 is changed in the direction transverse to the unwinding direction (arrow X) of the continuous sheet of additional member Q.

In such a case, by performing the position change of the roll blades 22*a* and 22*b* of the second cutter 11 within a period from the time the unwinding by the unwinding unit 5 is started to the time the additional member R cut by the first cutter 9 reaches the second cutter 11, it is possible to change the size of the book block B without stopping the operation of the additional member attaching apparatus 1.

Although the preferred embodiment of the present disclosure has been described above, the configuration of the present disclosure is not limited to the embodiment described above, and it is obvious that those skilled in the art may propose various modified examples within the scope of the configuration described in the appended claims.

What is claimed is:

1. An additional member attaching apparatus connected connectable to a binder and configured to supply an additional member from outside of the binder and attach the additional member to a glue-applied spine of a book block stopped at an additional member attaching position inside the binder, the additional member attaching apparatus comprising:

a roll accommodation unit that accommodates a roll of a continuous sheet of the additional member rotatably about an axis;

a unwinding unit that unwinds and draws the continuous sheet of additional member from the roll accommodation unit to a trimming station; and a trimming unit that is arranged in the trimming station and cuts and trims the continuous sheet of additional member unwound and drawn by the unwinding unit in accordance with a size of the book block to form a strip of additional member;

an additional member transfer and attaching unit that, in a state where the additional member attaching apparatus is connected to the binder, transfers the strip of additional member to the additional member attaching position inside the binder and attaches the strip of additional member to the spine of the book block stopped at the additional member attaching position; and a control unit that controls the unwinding unit so as to intermittently unwind and draw the continuous sheet of additional member by a length in accordance with a thickness of the book block, wherein the trimming unit comprises:

a first cutter that cuts the continuous sheet of additional member, which was unwound and drawn by the unwinding unit, in a direction transverse to an unwinding direction by a length in accordance with a thickness of the book block, and a second cutter that trims the additional member, which was cut by the first cutter, in the unwinding direction in accordance with a head-to-foot length of the book block, wherein the control unit controls a position of the second cutter so that the position corresponds to a head-to-foot length of the book block, and wherein the head-to-foot length and thickness of the book block are input into the control unit.

2. The additional member attaching apparatus according to claim 1, wherein the control unit controls the first cutter in synchronization with the unwinding unit that intermittently operates.

3. The additional member attaching apparatus according to claim 1, wherein the first cutter comprises:

a straight blade extending above an unwinding path of a continuous sheet of additional member and across the unwinding path and configured to move vertically, a blade rest plate arranged facing the straight blade under the unwinding path, and a straight blade drive mechanism configured to cause the straight blade to move between a standby position where the straight blade is distant from the blade rest plate by a predetermined distance and a cutting position where the straight blade engages with the blade rest plate, and wherein the second cutter comprises:

at least one slide guide extending across the transport path of the transport mechanism, a blade holder mounted slidably to the at least one slide guide, a holder drive mechanism configured to move the blade holder to slide, a pair of roll blades mounted to the blade holder such that the pair of roll blades face each other vertically interposing the transport path and are rotatable about respective shafts extending across the transport path, and a rotation drive mechanism coupled to at least one of the shafts of the pair of roll blades.

4. The additional member attaching apparatus according to claim 3, wherein the trimming unit further has a stopper extending across the transport path on the downstream of the second cutter on transport path and configured to stop the strip of additional member when a leading end of the strip of additional member transported on the transport path comes into contact with the stopper.

5. A binding system comprising:

the additional member attaching apparatus according to claim 1; and a binder to which the additional member attaching apparatus is connected.

6. An additional member attaching apparatus connectable to a binder and configured to supply an additional member from outside of the binder and attach the additional member to a glue-applied spine of a book block stopped at an additional member attaching position inside the binder, the additional member attaching apparatus comprising:

a roll accommodation unit that accommodates a roll of a continuous sheet of the additional member rotatably about an axis;

a unwinding unit that unwinds and draws the continuous sheet of additional member from the roll accommodation unit to a trimming station;

a trimming unit that is arranged in the trimming station and cuts and trims the continuous sheet of additional member unwound and drawn by the unwinding unit in accordance with a size of the book block to form a strip of additional member;

wherein the trimming unit has a first cutter that cuts the continuous sheet of additional member, which was unwound and drawn by the unwinding unit, in a direction transverse to an unwinding direction by a length in accordance with a thickness of the book block, and has a second cutter that trims the additional member, which was cut by the first cutter, in the unwinding direction in accordance with a head-to-foot length of the book block, wherein the book block stopped at the additional member attaching position stands upright, wherein the additional member attaching apparatus further comprises an additional member transfer and attaching unit, the additional member transfer and attaching unit includes:

a gripper configured to grip the strip of additional member while supporting an under face of the strip of additional member, a first gripper drive mechanism configured to cause the gripper to move between a retracted position inside a housing and a forward position outside the housing, a second gripper drive mechanism configured to cause the gripper to move between the forward position and a raised position above the forward position, and a handover unit configured to hand over the strip of the additional member from the trimming station to the gripper in the retracted position, wherein in a state where the additional member attaching apparatus is connected to the binder, the forward position of the gripper is right under the spine of the book block stopped at the additional member attaching position inside the binder, and the gripper in the raised position presses the strip of additional member to the spine of the book block.

* * * * *